US005465677A

United States Patent [19]

Alter

[11] Patent Number: 5,465,677

[45] Date of Patent: Nov. 14, 1995

[54] FLOAT POST APPARATUS

[76] Inventor: Sheldon Alter, 48 S. Masters Dr., Homosassa, Fla. 34446

[21] Appl. No.: 335,172

[22] Filed: Nov. 7, 1994

[51] Int. Cl.[6] ..... B63B 21/00

[52] U.S. Cl. ..... 114/230; 441/129; 441/136

[58] Field of Search ..... 441/129, 136, 441/130, 131, 132, 75; 114/230; 472/128, 129

[56] References Cited

U.S. PATENT DOCUMENTS

| | | | |
|---|---|---|---|
| 2,938,726 | 5/1960 | Hunter, Jr. | 472/128 |
| 3,677,539 | 7/1972 | Bennet | 472/129 |
| 4,041,562 | 8/1977 | Nealy | 441/75 |
| 4,689,032 | 8/1987 | Trossman | 114/230 |
| 4,726,313 | 2/1988 | Neal | 114/230 |
| 4,729,331 | 8/1988 | Eggleston | 441/130 |
| 5,299,588 | 4/1994 | MacLeod | 441/130 |

*Primary Examiner*—Sherman Basinger
*Attorney, Agent, or Firm*—John A. Haug

[57] ABSTRACT

A float post (12, 12', 12") is shown having one end (14) receivable in a mounting stand (20) or directly into the bottom surface of a body of water and a second end (16) which mounts a storage locker 50 having a plurality of beverage container holders mounted thereto. A tether mounting device (36,80,90) is mounted adjacent the second end and receives one end of a tether (46,46') with the opposite end of the tether formed with a loop for reception on a foot or other body part of a person on a floatation device. The post may be unitary of may have a plurality of telescoping sections (70,72,74) to provide adjustable length.

18 Claims, 3 Drawing Sheets

FLOAT POST APPARATUS

This invention relates generally to leisure and recreation activities and more specifically to leisure aquatic activities.

BACKGROUND OF THE INVENTION

Many people enjoy spending leisure time floating on a body of water on a floatation device such as an inflatable rubber raft, tube or the like. Such people find this very relaxing and an opportunity to read, listen to a radio or tape player, meditate or simply while away the time.

However, due to wind and water currents one must keep up a degree of vigilance in order to maintain a selected position of the floatation device, usually by a paddling motion of the arms or kicking of the legs. Yet another limitation on one's ability to totally relax relates to accessary items which one might have on the floatation device. For example, one might have a snack or can of soda balanced on the floatation device which tend to get wet and can easily be toppled over as one relaxes. Many times a person reads and then becomes drowsy and takes a brief nap during which time the book or magazine being read can easily get wet or be lost overboard.

SUMMARY OF THE INVENTION

It is an object of the invention to provide novel apparatus for use with water floatation devices to maintain the position of such device while a person is disposed thereon. Another object is the provision of such apparatus which will alleviate the problem of maintaining accessary items in a safe and dry condition to thereby allow a person on the floatation device to totally relax.

These and other objects, features and advantages of the present invention will become apparent from the following detailed description of the invention.

Briefly described, a novel float post apparatus made in accordance with the invention comprises an elongated post adapted to be placed in a body of water with a first end anchored in or at the bottom surface and the second end disposed above the surface of the water. The apparatus includes a tether having an end thereof attachable to the second end of the post and an opposite end formed with a loop adapted to be received on a foot or other body part of a person on a floatation device. According to a feature of the invention the post is preferably tapered with the first end receivable in a weighted mounting stand and which may be locked therein by a removable pin or the like. The mounting stand is particularly suitable for use in swimming pools or other bodies of water having a solid or rocky bottom. In appropriate locations having a sandy or muddy bottom the first end of the post can be directly driven into the bottom material. According to a feature of the invention, the post may be of a single selected length or, preferably, may be composed of a plurality of telescoping sections so that the effective length of the post can be adjusted as desired for different locations. According to another feature of the invention a tether mounting device is attached to the second end of the post so that the first end of the tether can be conveniently attached thereto as by use of a hook. In one embodiment a simple hook is shown while in another embodiment a lockable hook is employed. In one embodiment the mounting device is in the form of a ring spaced from and attached to the post by suitable fasteners. In another embodiment a rod is attached to an inner and an outer ring with the rod received in an axially extending slot formed in the outer end of the second end of the post and with the outer ring adapted to receive the hook of the tether. According to a feature of the invention a locker having a downwardly extending leg is disposed on top of the second end of the post with the leg received into the interior of the post. The locker can be used to stow various accessory items such as snacks, reading material, tape players and tapes, and so on. According to yet another feature a plurality of beverage container holders are mounted about the periphery of the locker. Preferably, a longitudinally extending slot is formed in each holder to accommodate handles of cups or the like.

BRIEF DESCRIPTION OF THE DRAWINGS

Other objects, advantages and details of the novel and improved float post apparatus of this invention appear in the following detailed description of preferred embodiments of the invention, the detailed description referring to the drawings in which.

DETAILED DESCRIPTION OF PREFERRED EMBODIMENTS

Figure 2:
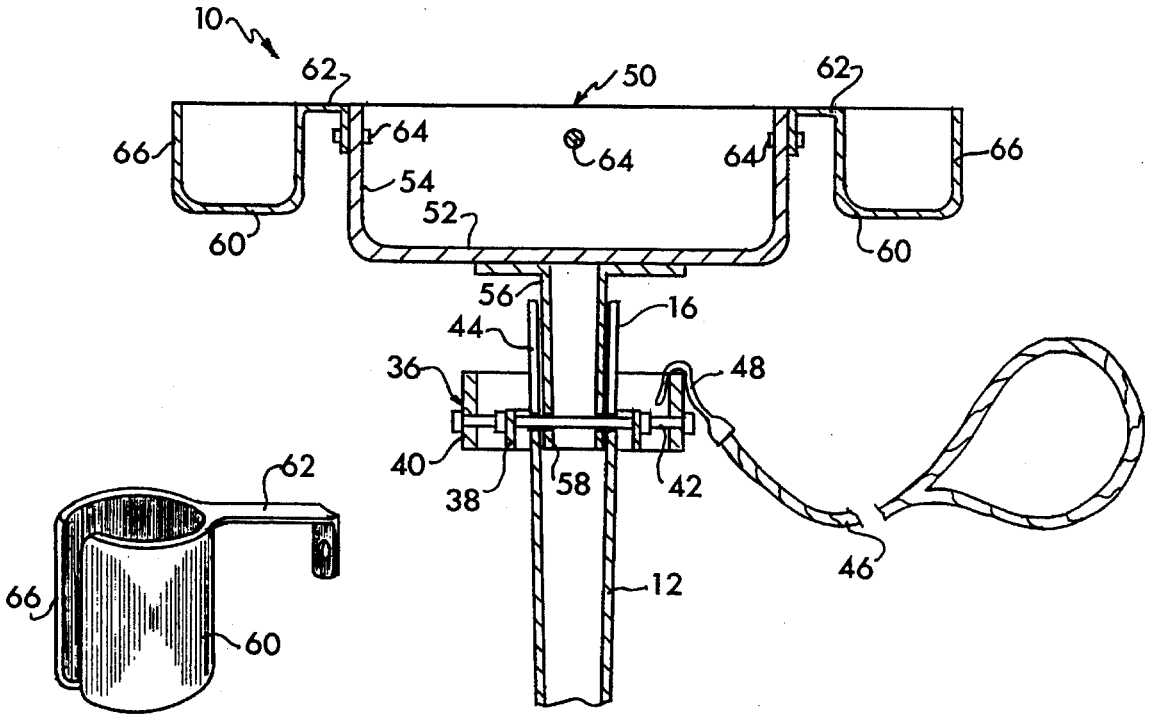
FIG. 2 is a perspective view of a beverage container holder shown in FIG. 1.

Referring to the drawings, a float post apparatus 10 made in accordance with the invention comprises an elongated, preferably tubular, post 12 of suitable material such as aluminum, having a first end 14 and an opposite second end 16. Post 12 is preferably tapered with first end 14 adapted to be received in a seat 18 of a mounting stand 20. Seat 18 has a tubular configuration generally matching that of first end 14 and having sufficient length to provide a stable support for post 12. Preferably an aperture 22 is formed through neck 24 of stand 20 so that the post can be locked in place by means of a pin 26 received through apertures 22 and an alignable aperture 28 in post 12. A suitable nut or other locking means can be placed on the end of pin 26 to maintain it in position as desired. Stand 20 is preferably provided having a cavity which can be filled with suitable ballast material, such as sand, through an inlet 32 having a conventional closure element 34.

A tether mounting device 36 is attached to post 12 adjacent the second end 16 and comprises inner and outer sleeve elements 38,40 respectively spaced from one another and joined together by a rod 42. End 16 is formed with a longitudinaly extending slot 44 adapted to receive rod 42 therein with sleeve 38 received about post 12 and sleeve 40 spaced therefrom so that a tether can be easily attached to it, as described below. Sleeve 38 serves to limit pivotal motion of the device about rod 42.

Tether 46 has a first end formed with hook means such as a simple hook 48 adapted to slip over sleeve 40 and a second end preferably formed into a loop which can be conveniently received over one's foot or other body part.

A locker 50 having a bottom wall 52 and sidewalls 54 extending upwardly therefrom is provided with a downwardly extending leg 56, preferably tapered and configured such as to fit in the open end 16 of tubular post 12. The lower end of leg 56 may be slotted at 58 to form bifurcations to fit over rod 42 to more securely mount locker 50 to the post. If desired, locker 50 can be provided with a cover (not shown) and preferably has a plurality of beverage container holders 60, see also FIG. 2. Holders 60 have an arm 62 for attachment to side wall 54 of locker 50 by any convenient means such as conventional fasteners 64, and preferably are provided with a slot 66 in the side wall thereof extending down to the bottom wall to accommodate containers such as coffee mugs having handles attached thereto.

In use, one can place a variety of items such as snacks, reading material, etc. in locker 50, place the loop of tether 46 over one's foot with the hook on sleeve 40 and then totally relax on a float without any concern that the float will move away from the selected position and with a place to stow things when not being used.

Figure 3:
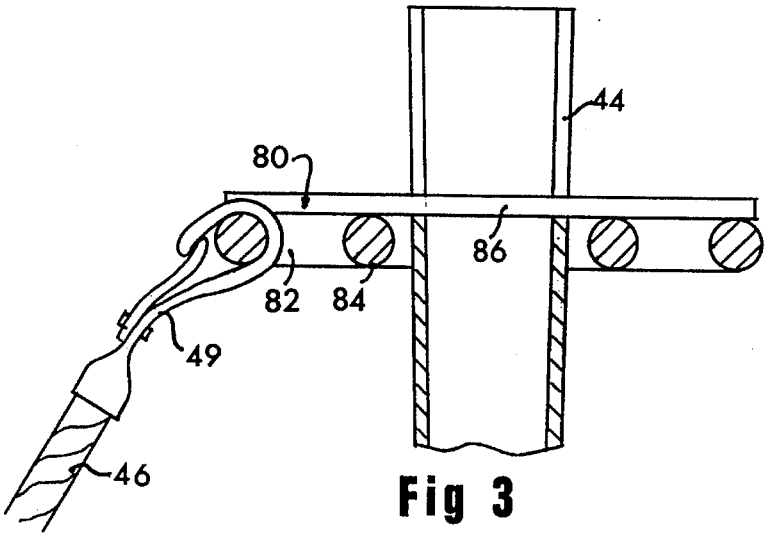
FIG. 3 is a cross sectional view of the top portion of the float post apparatus of a second embodiment of the invention.
Figure 4:
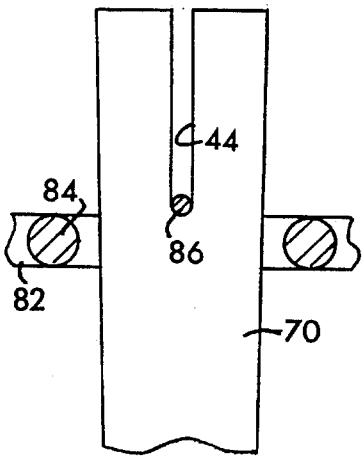
FIG. 4 is a side view of the FIG. 3 embodiment with a portion broken away and in cross section.
Figure 5:
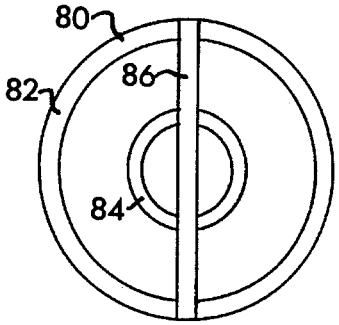
FIG. 5 is a top view of a tether mountin device shown in FIGS. 3 and 4.

FIGS. 3–5 show a modified tether mounting device 80. Device 80 comprises outer and inner rings 82,84 respectively connected to and spaced from one another by a rod 86 as by welding. Rod 86 is received in slot 44 of section 70 in the same manner as rod 42 is received in slot 44 of post 12 in FIG. 1. In this embodiment a lockable hook fastener 49 is attached to tether 46' to provide a more secure attachment to the float post and a higher degree of security for a person tethered to the post.

Figure 6:
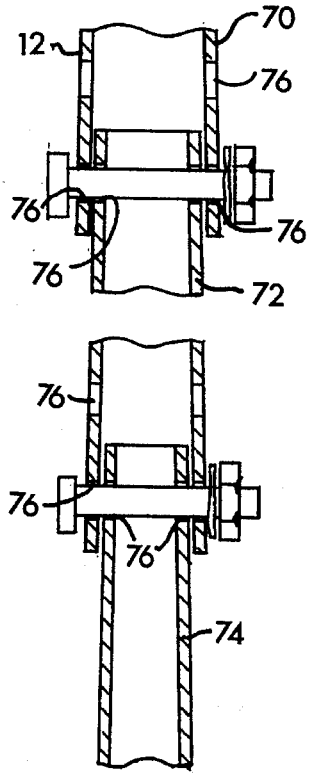
FIG. 6 is a cross sectional view of a broken away portion of an embodiment comprising an adjustable length float post.

FIG. 6 shows a modified embodiment in which post 12' is provided in a plurality of telescoping sections 70,72,74. Three sections are shown but the particular number is a matter of choice. Each of the sections preferably has a plurality of pairs of apertures 76 spaced along the longitudinal axis of the sections for reception of a pin or the like in selected apertures to provide adjustability of the post to a variety of different lengths. A slot 44, although not shown in FIG. 6, can be provided in each of the sections to accommodate rod 42, or if desired, sections 72,74 can be formed slightly shorter in length so that they can be stacked up below rod 42 while still being completely within section 70.

Figure 7:
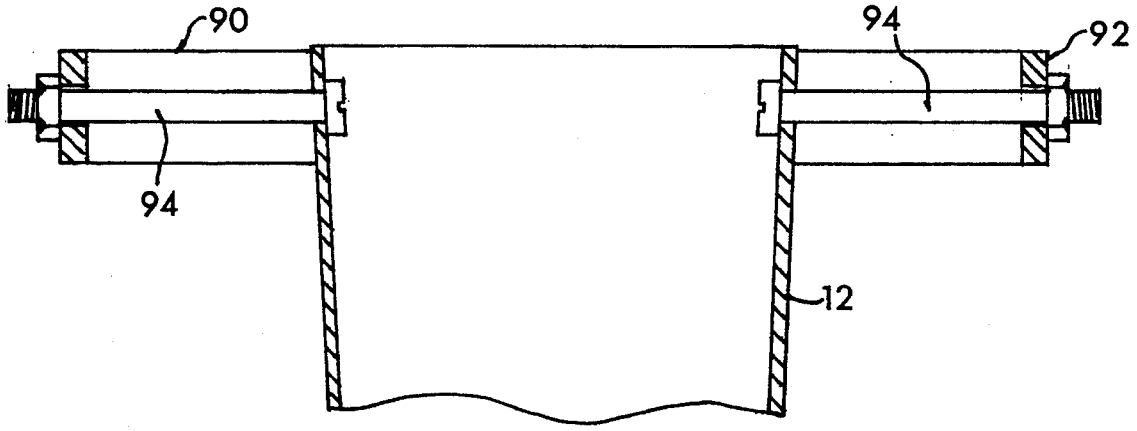
FIG. 7 is a cross sectional view of the top portion of a float post apparatus of another embodiment of the invention.

FIG. 7 shows another modified embodiment in which the mounting device 90 comprises a tether attaching ring 92 which is mounted directly to the wall of post 12". It will be understood that the diameter of leg 56 can be selected so that it can pass by the heads of bolts 94 and have sufficient length to provide a stable mounting for storage locker 50.

Figure 1:
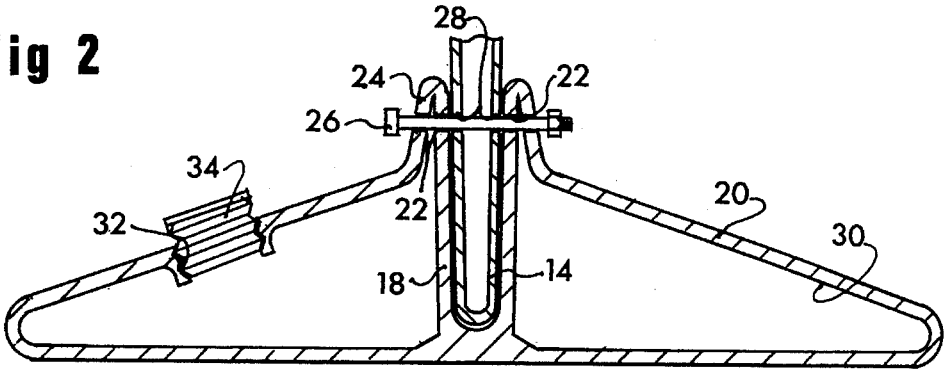
FIG. 1 is a cross sectional view of a float post apparatus, partly broken away, made in accordance with the invention.
Figure 8:
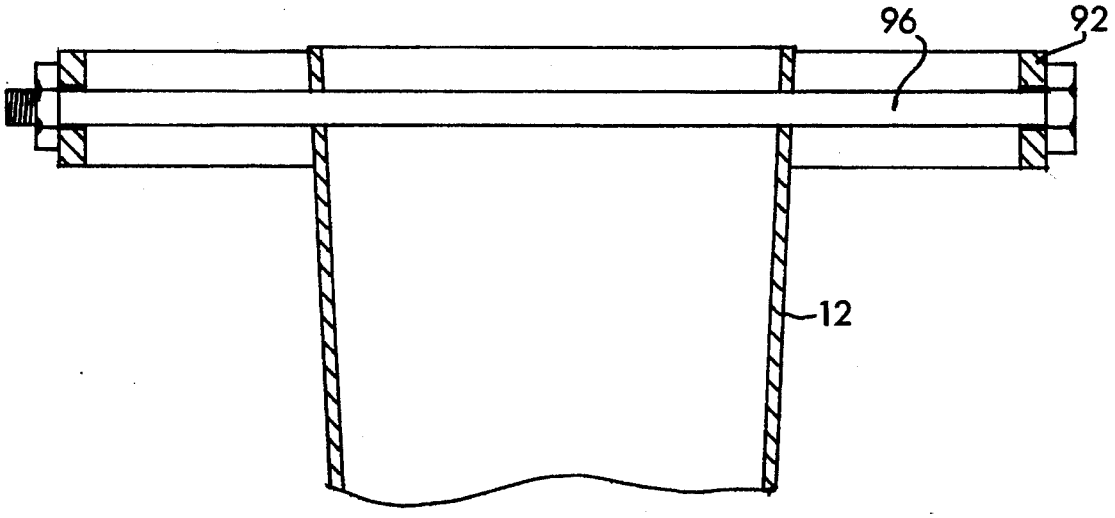
FIG. 8 is a cross sectional view of a broken away portion of a modified embodiment similar to that of FIG. 7.

FIG. 8 shows rod 96 extending through post 12" and, as in the embodiment shown in FIG. 1, can cooperate with the bifurcations of leg 56 of storage locker 50 to more securely mount locker 50 on the post.

It should be understood that although particular embodiments of the invention have been described by way of illustrating the invention, the invention includes all modifications thereof falling within the scope of the appended claims.

What is claimed:

1. Float post apparatus comprising an elongated post having first and second opposite ends, a tether having first and second ends, tether mounting means attached to the post adjacent the second end, the first end of the tether having attachment means to attach the tether to the tether mounting means and the second end of the tether having attachment means to attach the tether to a person, the first end of the post adapted to be anchored at the bottom of a body of water, a mounting stand having a post receiving seat adapted to receive the first end of the float post, the mounting stand having a neck portion and having the post receiving seat formed in the neck portion, an aperture formed through the neck portion and a corresponding aperture formed through the post adjacent the first end of the post and being in alignment with the aperture in the neck when the post is received in the post receiving seat, and a locking member received in the apertures to lock the post to the mounting stand and a storage locker mounted on the second end of the post.

2. Float post apparatus according to claim 1 in which the attachment means of the first end of the tether is a hook.

3. Float post apparatus according to claim 1 in which the attachment means of the second end of the tether is a loop adapted to fit over a foot of a user.

4. Float post apparatus according to claim 1 in which the elongated post comprises a plurality of telescoping sections and further including means to lock the sections in different positions to provide adjustable length of the post.

5. Float post apparatus according to claim 1 in which the tether mounting means comprises a ring attached to the post and spaced a selected distance therefrom.

6. Float post apparatus comprising an elongated post having first and second opposite ends, a tether having first and second ends, tether mounting means attached to the post adjacent the second end, the first end of the tether having attachment means to attach the tether to the tether mounting means and the second end of the tether having attachment means to attach the tether to a person, the first end of the post adapted to be anchored at the bottom of a body of water and a storage locker mounted on the second end of the post, the tether mounting means comprising a ring attached to the post and spaced a selected distance therefrom, the post having a longitudinal axis and a slot formed in the post at the second end, the slot extending a selected distance along the longitudinal axis and the ring having a rod extending across the ring, the ring being received in the slot to mount the tether mounting device on the post.

7. Float post apparatus according to claim 6 in which the post is tapered.

8. Float post apparatus comprising an elongated post having first and second opposite ends, a tether having first and second ends, tether mounting means attached to the post adjacent the second end, the first end of the tether having attachment means to attach the tether to the tether mounting means and the second end of the tether having attachment means to attach the tether to a person, the first end of the post adapted to be anchored at the bottom of a body of water, a storage locker mounted on the second end of the post, beverage container holders disposed around the outer periphery of the storage locker, the beverage container holders each has a bottom wall and an upwardly extending side wall having a distal end portion formed with a longitudinally extending slot extending from the bottom wall to the distal end portion of the side wall to accommodate a handle of a beverage container.

9. Float post apparatus according to claim 6 in which the storage locker has a bottom wall and a leg depending from the bottom wall, the leg having a distal free end formed with bifurcations, the rod recieved between the bifurcations to more securely mount the storage locker.

10. Float post apparatus according to claim 1 in which the post is tubular having an open second end and the storage locker has a bottom wall and a leg depending from the bottom wall, the leg received in the open second end of the post.

11. Float post apparatus according to claim 6 in which the attachment means of the first end of the tether is a hook.

12. Flost post apparatus according to claim 8 in which the attachment means of the first end of the tether is a hook.

13. Float post apparatus according to claim 6 in which the attachment means of the second end of the tether is a loop adapted to fit over a foot of a user.

14. Float post apparatus according to claim 8 in which the attachment means of the second end of the tether is a loop adapted to fit over a foot of a user.

15. Float post apparatus according to claim 8 in which the post is tapered.

16. Float post apparatus according to claim 6 in which the elongated post comprises a plurality of telescoping sections and further including means to lock the sections in different positions to provide adjustable length of the post.

17. Float post apparatus according to claim 8 in which the elongated post comprises a plurality of telescoping sections and further including means to lock the sections in different positions to provide adjustable length of the post.

18. Float post apparatus according to claim 6 further including beverage container holders disposed around the outer periphery of the storage locker.

* * * * *